US008540235B2

(12) United States Patent
Kern et al.

(10) Patent No.: US 8,540,235 B2
(45) Date of Patent: Sep. 24, 2013

(54) CONVEYING APPARATUS FOR ENVELOPES AND RELATED METHODS

(76) Inventors: Peter Kern, St. Peter Port (GB); Reinhard Buri, Donaueschingen (DE); Axel Schütz, Bräunlingen (DE)

( * ) Notice: Subject to any disclaimer, the term of this patent is extended or adjusted under 35 U.S.C. 154(b) by 0 days.

(21) Appl. No.: 12/231,730

(22) Filed: Sep. 5, 2008

(65) Prior Publication Data

US 2010/0058719 A1 Mar. 11, 2010

(51) Int. Cl.
*B65H 1/02* (2006.01)

(52) U.S. Cl.
USPC ..... 271/150; 271/149; 198/465.3

(58) Field of Classification Search
USPC ..... 271/2, 149, 150; 198/465.3
See application file for complete search history.

(56) References Cited

U.S. PATENT DOCUMENTS

| | | | | |
|---|---|---|---|---|
| 24,459 | A | 6/1859 | Hall | |
| 2,915,863 | A | 12/1959 | Kummer | |
| 3,253,384 | A | 5/1966 | Huck et al. | |
| 3,568,401 | A | 3/1971 | Bonsch | |
| 3,753,836 | A | 8/1973 | Buckholz | |
| 3,872,649 | A | 3/1975 | Wimmer | |
| 4,132,402 | A | 1/1979 | Morrison et al. | |
| 4,328,962 | A * | 5/1982 | Akers | 271/12 |
| 4,360,356 | A | 11/1982 | Hall | |
| 4,473,430 | A | 9/1984 | Voltmer et al. | |
| 4,605,457 | A | 8/1986 | Guy | |
| 4,641,489 | A * | 2/1987 | Wood | 53/529 |
| 4,649,691 | A | 3/1987 | Buckholz | |
| 5,161,792 | A * | 11/1992 | Wood | 271/151 |
| 5,191,751 | A | 3/1993 | Marzullo et al. | |
| 5,244,199 | A * | 9/1993 | Wood | 271/150 |
| 5,251,425 | A | 10/1993 | Kern | |
| 5,297,785 | A * | 3/1994 | Ricciardi | 271/3.18 |
| 5,327,705 | A | 7/1994 | DeFigueiredo | |
| 5,487,254 | A | 1/1996 | Dronsfield | |
| 5,675,959 | A | 10/1997 | Hamma et al. | |
| 5,957,448 | A | 9/1999 | Frank et al. | |

(Continued)

FOREIGN PATENT DOCUMENTS

| | | |
|---|---|---|
| CA | 2 373 321 | 11/2000 |
| DE | 37 00 112 | 7/1988 |

(Continued)

OTHER PUBLICATIONS

Third Office Action issued in related Chinese Patent Application No. 200380109842.0; Mar. 27, 2009; 8 pages; Chinese Patent Office.

(Continued)

*Primary Examiner* — Patrick Mackey
(74) *Attorney, Agent, or Firm* — Wood, Herron & Evans, LLP

(57) ABSTRACT

An apparatus for conveying envelopes traveling in a travel direction in a generally upright orientation. The apparatus includes a first pair of conveyor assemblies disposed opposite one another and configured to engage lateral edges of the envelopes, and configured to move the envelopes in the travel direction. The apparatus includes a second pair of conveyor assemblies disposed opposite one another and positioned downstream of the first pair of conveyor assemblies in the travel direction, with the second pair of conveyor assemblies being configured to move the envelopes in the travel direction independently of the first pair of conveyor assemblies.

28 Claims, 7 Drawing Sheets

(56) References Cited

U.S. PATENT DOCUMENTS

| | | | | |
|---|---|---|---|---|
| 5,971,391 | A * | 10/1999 | Salomon et al. | 271/153 |
| 5,992,132 | A | 11/1999 | Auerbach | |
| 6,352,257 | B1 | 3/2002 | Todaro et al. | |
| 6,561,502 | B1 | 5/2003 | Flickner | |
| 6,755,411 | B2 * | 6/2004 | Janatka et al. | 271/2 |
| 2006/0087071 | A1 * | 4/2006 | Schnuelle et al. | 271/149 |
| 2006/0156876 | A1 | 7/2006 | Sussmeier et al. | |
| 2006/0249895 | A1 | 11/2006 | Kern | |
| 2007/0040316 | A1 | 2/2007 | Kern | |
| 2008/0087147 | A1 | 4/2008 | Sussmeier et al. | |
| 2008/0106022 | A1 | 5/2008 | Sussmeier et al. | |

FOREIGN PATENT DOCUMENTS

| | | |
|---|---|---|
| DE | 298 13 546 | 11/1998 |
| EP | 0 253 995 | 1/1988 |
| EP | 0 504 114 | 9/1992 |
| EP | 0 876 908 | 11/1998 |
| EP | 1 108 563 | 6/2001 |
| EP | 1 297 970 | 4/2003 |
| EP | 1 622 778 | 11/2004 |
| EP | 1 683 651 | 7/2006 |
| WO | 2004/098905 | 11/2004 |

OTHER PUBLICATIONS

Irina Becker; Invitation to Pay Additional Fees in related PCT patent application No. PCT/US2009/030538; Apr. 1, 2009; 5 pages; European Patent Office.

Irina Becker; Invitation to Pay Additional Fees in related PCT patent application No. PCT/US2009/030549; Apr. 8, 2009; 5 pages; European Patent Office.

Ole Henningsen; International Search Report and Written Opinion issued in related PCT Application No. PCT/US2009/030536; Jun. 3, 2009; 12 pages; European Patent Office.

Ole Henningsen; International Search Report and Written Opinion issued in related PCT Application No. PCT/US2009/030559; Jun. 2, 2009; 11 pages; European Patent Office.

* cited by examiner

CONVEYING APPARATUS FOR ENVELOPES AND RELATED METHODS

CROSS-REFERENCE

This application is generally related to the following co-pending U.S. patent applications: Ser. No. 12/231,739, entitled "Apparatus for Guiding and Cutting Web Products and Related Methods;" U.S. Pat. No. 7,717,418, entitled "Envelope Conveying and Positioning Apparatus and Related Methods;" Ser. No. 12/231,753, entitled "Inserting Apparatus for Discrete Objects into Envelopes and Related Methods;" Ser. No. 12/231,754, entitled "Transporting Apparatus for Discrete Sheets into Envelopes and Related Methods;" and Ser. No. 12/231,749, entitled "Transporting Apparatus for Web Products and Related Methods", all being filed on even date herewith and expressly incorporated herein by reference in their entirety.

TECHNICAL FIELD

The present invention generally relates to converting equipment and, more particularly, to apparatus for converting paper into sheets, collating and automatic envelope stuffing operations.

BACKGROUND

Converting equipment is known for automatically stuffing envelopes. Such equipment may include components for feeding a pre-printed web of paper, for cutting such web into one or more discrete sheets for collating sheets, and for feeding such discrete sheet collations into envelopes. Such equipment may further include components to convey the stuffed envelopes to a specified location. The industry has long known apparatus which accomplish these and other functions. However, improvements are needed where high volumes of paper piece count and high speeds are required without sacrificing reliability accuracy and quality of end product.

More particularly, a large roll of paper is typically printed in discrete areas with piece specific information. That is, the initial roll of paper comprises vast numbers of discrete areas of already-printed indicia-specific information with each discrete area defining what is to eventually comprise a single page or sheet of indicia specific information. To complicate the process, a variable number of sheets with related indicia must be placed into the envelopes so that the content of one envelope varies from the content of another by sheet count and, of course, by the specific indicia on the included sheets. As one example, financial reports of multiple customers or account specifics may require a varied number of customer or account specific sheets to be cut, respectively collated, stuffed and discharged for delivery. Thus, the contents of each envelope include either a single sheet or a "collation" of from two to many sheets, each "collation" being specific to a mailing to an addressee.

In such an exemplary operation, a financial institution might send billing or invoice information to each of its customers. The billing information or "indicia" for one customer may require anywhere from one final sheet to a number of sheets which must be collated, then placed in that customer's envelope. While all this information can be printed in sheet size discrete areas, on a single roll, these areas must be well defined, cut, merged or collated into sheets for the same addressee or destination, placed into envelopes, treated and discharged. Thus, a system for conducting this process has in the past included certain typical components, such as a paper roll stand, drive, sheet cutter, merge unit, accumulate or collate unit, folder, envelope feeder, envelope inserter, and finishing and discharge units. Electronic controls are used to operate the system to correlate the functions so correct sheets are collated and placed in correct destination envelopes.

In such multi-component systems, the pass-through rate from paper roll to finished envelope is dependent on the speed of each component, and overall production speed is a function of the slowest or weakest link component. Overall reliability is similarly limited. Moreover, the mean down time from any malfunction or failure to repair is limited by the most repair-prone, most maintenance consumptive component. Such systems are capital intensive, requiring significant floor plan or footprint, and require significant labor, materials and maintenance capabilities and facilities.

In such a system, it is sometimes necessary to convey envelopes toward a stuffing station. In conventional systems of this type, operation may require a user to load envelopes on the conveyor in a continuous fashion, with a gap between envelopes sometimes interrupting the flow of envelopes to the stuffing station.

Accordingly, it is desirable to provide an improved envelope conveying system and methods in a high speed handling machine. It is also desirable to provide an envelope conveying system and related methods that address inherent problems observed with conventional paper systems. Moreover, it is also desirable to provide a converting apparatus in the form of an automatic envelope stuffing machine that address the problems with conventional machines used to automatically stuff envelopes.

SUMMARY

To these ends, in one particular embodiment of the invention an apparatus is provided for conveying envelopes traveling in a travel direction in a generally upright orientation. The apparatus includes a first pair of conveyor assemblies disposed opposite one another and configured to engage lateral edges of the envelopes, and configured to move the envelopes in the travel direction. The apparatus includes a second pair of conveyor assemblies disposed opposite one another and positioned downstream of the first pair of conveyor assemblies in the travel direction, with the second pair of conveyor assemblies being configured to move the envelopes in the travel direction independently of the first pair of conveyor assemblies.

At least a portion of the first pair of conveyor assemblies may overlap the second pair of conveyor assemblies in the travel direction. At least one of the first or second pairs of conveyor assemblies may include deflectable elements for engaging the lateral edges of the envelopes. The deflectable elements may flex in response to the respective thicknesses of the envelopes to allow the envelope edges to reside slightly between individual bristles. The deflectable elements may be configured to flex in a direction opposite the travel direction to thereby permit movement of the first pair of conveyor assemblies relative to envelopes held by the second pair of conveyor assemblies. The deflectable elements may, for example, include bristles.

The first and second pairs of conveyor assemblies may be configured to respectively hold first and second envelopes in generally upright orientations, with the first and second pairs of conveyor assemblies being configured to move the first and second envelopes at respective first and second speeds that are substantially equal to one another. The apparatus may include a drive apparatus for driving the first pair of conveyor assemblies and at least one sensor that is operatively coupled to the drive apparatus and configured to detect a gap in front of a first envelope carried by the first pair of conveyor assemblies in the travel direction and send a corresponding signal to the drive apparatus. The drive apparatus is responsive to the signal to advance the first pair of conveyor assemblies and move the first envelope at a first speed greater than a second speed associated with the second pair of conveyor assemblies. The drive apparatus may be configured, in response to the signal, to accelerate the first pair of conveyor assemblies to thereby close the gap detected by the at least one sensor.

In another embodiment, an apparatus is provided for conveying envelopes traveling in a travel direction in a generally upright orientation. The apparatus includes a first pair of conveyor assemblies disposed opposite one another and including deflectable elements for engaging lateral edges of the envelopes, with the first pair of conveyor assemblies being configured to move the envelopes in the travel direction. A second pair of conveyor assemblies are disposed opposite one another and include deflectable elements for engaging lateral edges of the envelopes, and are positioned downstream of the first pair of conveyor assemblies, with the second pair of conveyor assemblies being configured to move the envelopes in the travel direction independently of the first pair of conveyor assemblies. A drive apparatus drives the first pair of conveyor assemblies. At least one sensor is operatively coupled to the drive apparatus and is configured to detect a gap in front of a first envelope carried by the first pair of conveyor assemblies in the travel direction, with the drive apparatus being responsive to a signal received from the at least one sensor to accelerate the first envelope and thereby close the gap detected by the at least one sensor.

In yet another embodiment, an automatic envelope stuffing machine is provided. The machine includes a first end associated with feeding of a roll of paper and a processing apparatus for converting the roll of paper into discrete sheets. A stuffing apparatus feeds the discrete sheets into envelopes, with a second end having a conveying apparatus for conveying the envelopes toward the stuffing apparatus in a travel direction. The conveying apparatus includes a first pair of conveyor assemblies that are disposed opposite one another and which are configured for engaging lateral edges of the envelopes, with the first pair of conveyor assemblies being configured to move the envelopes in the travel direction. The conveying apparatus also includes a second pair of conveyor assemblies that are disposed opposite one another and that are positioned downstream of the first pair of conveyor assemblies in the travel direction, with the second pair of conveyor assemblies being configured to move the envelopes in the travel direction independently of the first pair of conveyor assemblies. At least one of the first and second pairs of conveyor assemblies may include a plurality of deflectable elements for engaging the lateral edges of the envelopes.

In another embodiment, a method is provided for conveying envelopes traveling in a travel direction. The method includes sliding an envelope in a generally upright orientation between a first set of deflectable elements engaging opposite lateral edges of the envelope and moving the deflectable elements to thereby move the envelope in the travel direction. The envelope is transferred in the generally upright orientation to a second set of deflectable elements and the second set of deflectable elements is moved independently of the first set of deflectable elements to thereby move the envelope in the travel direction.

The method may include flexing the deflectable elements of the first set in response to a thickness of the envelope. The method may additionally or alternatively include detecting a gap in front of the envelope in the travel direction and accelerating movement of the first set of deflectable elements in the travel direction in response to detection of the gap. The first set of deflectable elements may be accelerated to close the gap. Sliding the envelope in the generally upright orientation may include moving the envelope in a direction transverse to the travel direction. Transferring the envelope in the generally upright orientation to the second set of deflectable elements may include moving the envelope in the travel direction. The method may include simultaneously engaging the envelope with the first and second sets of deflectable elements. The first set of deflectable elements may be moved relative to an envelope held by the second set of deflectable elements.

Such apparatus and methods are particularly useful in a paper converting and envelope stuffing system contemplating improved paper converting and sheet inserting apparatus and methods, modular based, and having improved paper handling apparatus, servo driven components, improved sensor density and improved control concepts controlling the system operation. One or more of the embodiments of the invention contemplate the provision of an improved envelope conveying apparatus which can be used as a module of a modular paper converting and sheet insertion system where human capital, required space, required equipment, maintenance, labor and materials and facilities therefore are reduced compared to conventional systems of similar throughput.

More specifically, such improved apparatus and methods contemplate a plurality of functional modules providing the following functions in a series of modules of like or dissimilar modules where a specific module is multi-functional. The functions comprise:

a printed paper roll handling/unwinding;
paper slitting and cutting;
sheet collation and accumulation;
sheet folding;
transportation for interfacing with inserts;
envelope feeding;
collation interfacing and insertion; and
envelope treating and discharge.

More particularly, one or more aspects of the invention may contemplate, without limitation, new and unique apparatus and methods for:

(a) guiding a web of the paper or film containing the printed indicia into a cutter apparatus;
(b) processing the web through slitting and transverse-cutting operation;
(c) transporting and merging discrete pieces of the insert;
(d) accumulating predefined stacks of discrete pieces of the insert;
(e) guiding and transporting a stack of discrete pieces of the insert toward an envelope-filling station;
(f) transporting individual envelopes toward the envelope-filling station;
(g) creating and processing a stack of the envelopes prior to the envelope-filling process; and
(h) processing an individual envelope from the stack of envelopes and through the envelope-filling station.

While the combination of the particular functions in the particular modules are unique combinations, the invention of this application lies primarily in the paper transporting apparatus and methods described herein.

DETAILED DESCRIPTION

Figure 1:
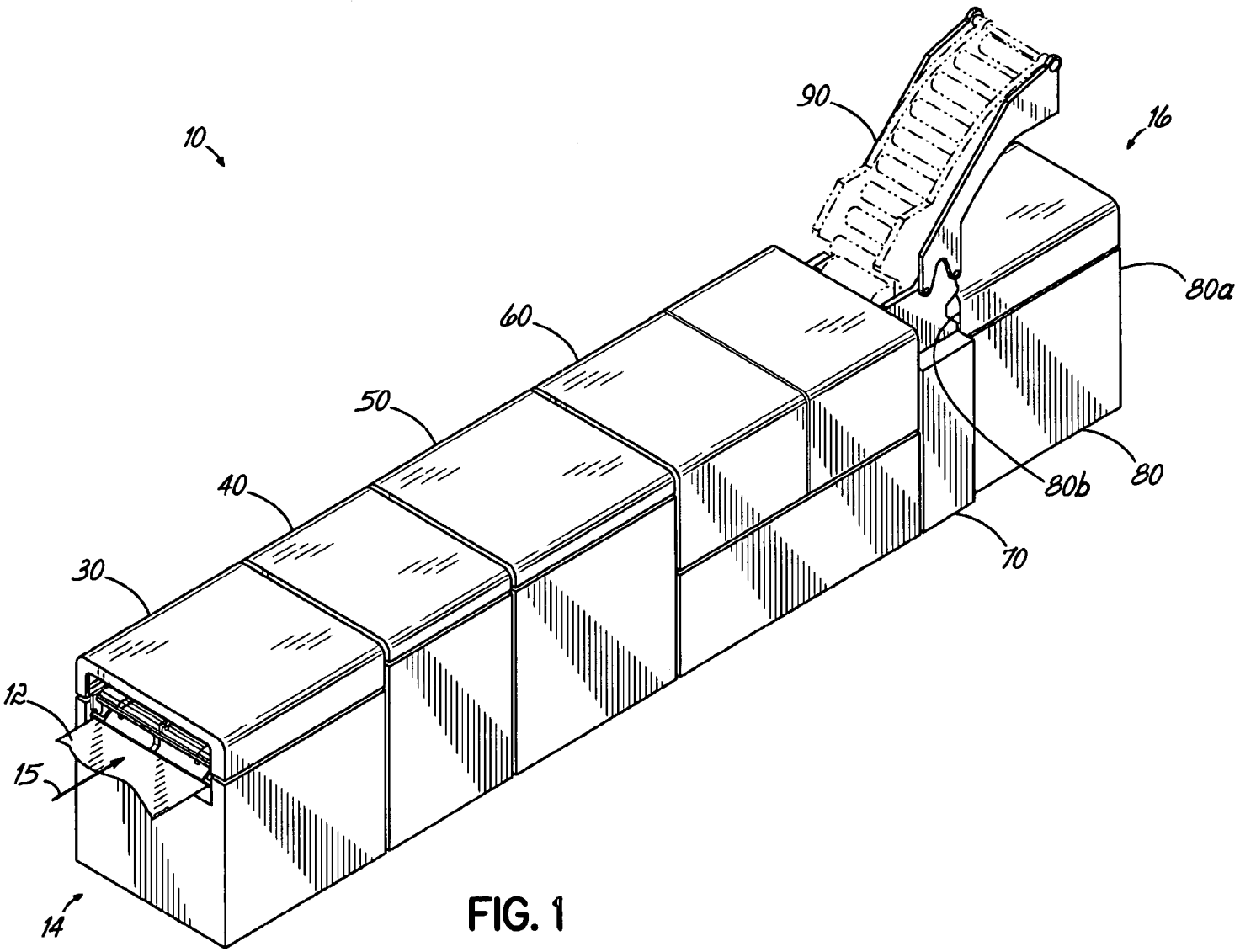
FIG. 1 is a perspective view illustrating a portion of a converter for stuffing envelopes with selected paper or film objects.

Referring to the figures and, more particularly to FIG. 1, a portion of an exemplary converter 10 is illustrated for processing a web 12 of paper or film. Although not shown, the web 12 processed by the converter 10 originates, for example, from a roll (not shown) of material containing such web. The roll is generally associated with a first end 14 of the converter 10 and is unwound in ways known in the art, for example, by driving a spindle receiving a core of the roll or by contacting a surface of the roll with a belt or similar apparatus. Typically, the web 12 is pre-printed with indicia in discrete areas.

The web 12 thus travels in a machine direction, generally indicated by arrow 15, through several modules that make up the converter 10. In the exemplary embodiment of FIG. 1, converter 10 cuts the web material into discrete sheets (corresponding to the "areas") of material ("inserts") and feeds them into envelopes fed generally from an opposite end 16 of converter 10. Converter 10 may further convey the envelopes containing the inserts away from the shown portion of the converter 10 for subsequent processing or disposition. The exemplary converter 10 includes, as noted above, several modules for effecting different steps in the processing of the web and the inserts resulting therefrom, as well as processing of the envelopes. Those of ordinary skill in the art will readily appreciate that converter 10 may include other modules in addition or instead of those shown herein.

A first of the shown modules, for example, is a cutting module 30 relatively proximate first end 14 of the converter 10 and which cuts the web 12 into discrete objects such as inserts (not shown) for subsequent processing. A conveying module 40 controls and transports the discrete inserts received from the cutting module and feeds them into a folding and buffering module 50. Module 50 may, if necessary, form stacks of the discrete inserts for subsequent processing, for example, if the intended production requires stuffing the envelopes with inserts defined by more than one discrete sheet. Module 50 folds the discrete inserts, if required by the intended production, along a longitudinal axis of the discrete inserts disposed generally along the machine direction. Moreover, module 50 accumulates, collates or buffers sets of the discrete sheets into individually handled stacks, if the particular production so requires.

With continued reference to FIG. 1, an uptake module 60 takes the inserts from folding and buffering module 50 and cooperates with components of a stuffing module 70 to transport the inserts and feed them into envelopes. The envelopes, in turn, are handled and fed toward the stuffing module 70 by an envelope conveyor 80. A conveying assembly 90 is operatively coupled to the stuffing module 70 and the envelope conveyor 80 for conveying the stuffed or filled envelopes away from the shown portion of converter 10 for subsequent processing or disposition.

Figure 2:
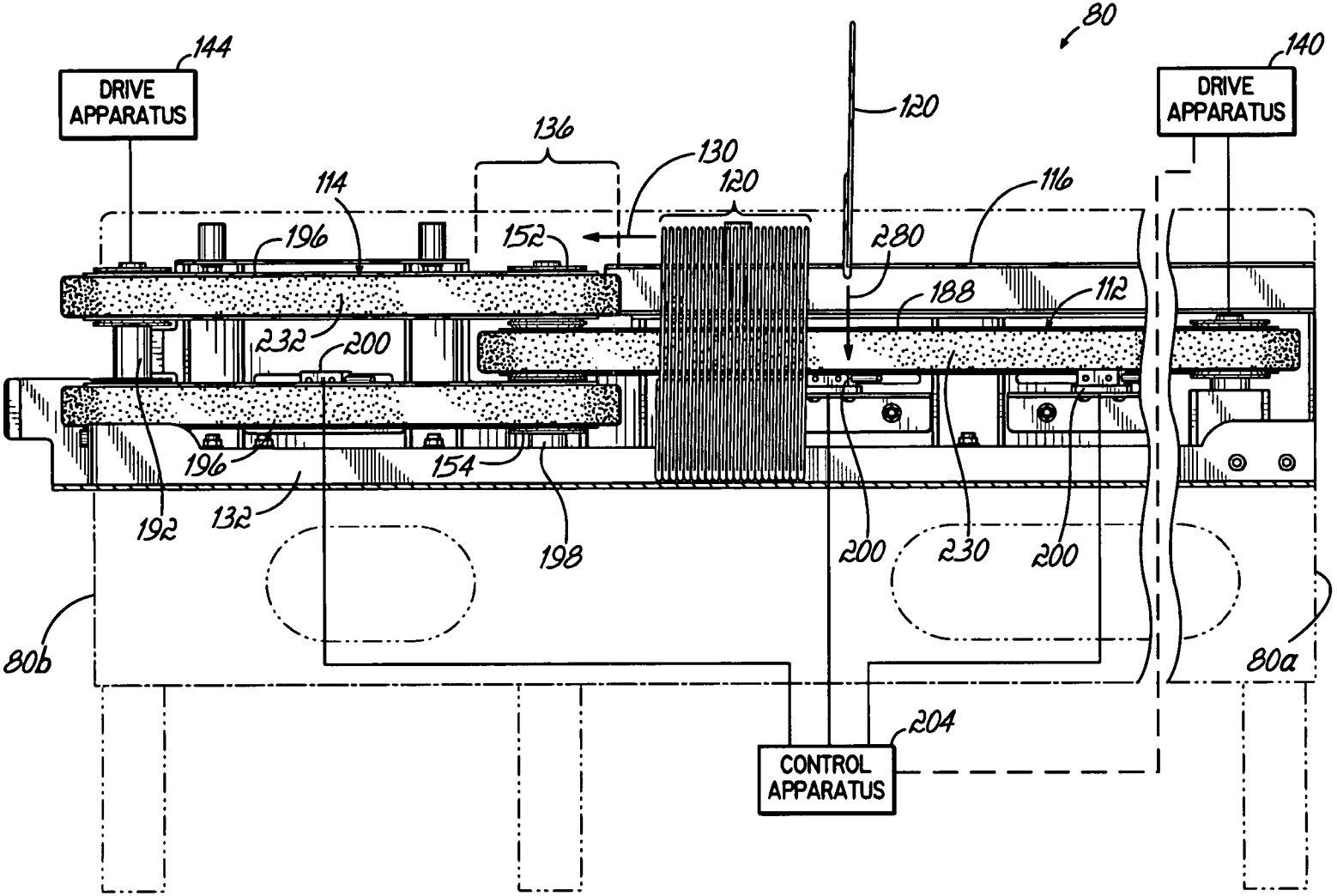
FIG. 2 is a cross-sectional view taken along line 2-2 of FIG. 4A.

With reference to FIG. 2, a portion of conveying module 80 is illustrated. Conveying module 80 includes a first pair on conveyor assemblies 112 (only one shown) that are disposed opposite one another and a second pair of conveyor assemblies 114 (only one shown), also disposed opposite one another and which cooperate to convey envelopes 120 in a travel direction 130 in an generally upright orientation. As used herein, the term "upright," when used to describe the orientation of the envelopes 120, is not intended to be limiting but rather exemplary. The term is therefore intended to apply to deviations from a vertical orientation and still fall within the scope of the present disclosure.

A frame 132 of module 80 supports the conveyor assemblies 112, 114, as well as a set of guiding rails 116 and bottom surface or floor 118 (FIGS. 4A-4B) that guide and support the envelopes 120. In this exemplary embodiment, the travel direction 130 is opposite the machine direction (arrow 15 of FIG. 1) although this is merely exemplary rather than limiting. In this regard, therefore, the travel direction defined by the conveying module 80 may instead by transverse or, alternatively, parallel to the machine direction (arrow 15), so long as the travel direction conveys the envelopes 120 towards a stuffing operation, such as that provided by stuffing module 70.

The first and second pairs of conveyor assemblies are driven by respective schematically-depicted drive apparatus 140, 144 which, for example, may include servo apparatus (not shown). While this embodiment schematically depicts two independent drive apparatus 140, 144, it is understood that a single drive apparatus may instead drive both pairs 112, 114 of conveyor assemblies, so long as such drive apparatus permits independent movement of the first and second pairs 112, 114 of conveyor assemblies relative to one another.

Figure 2A:
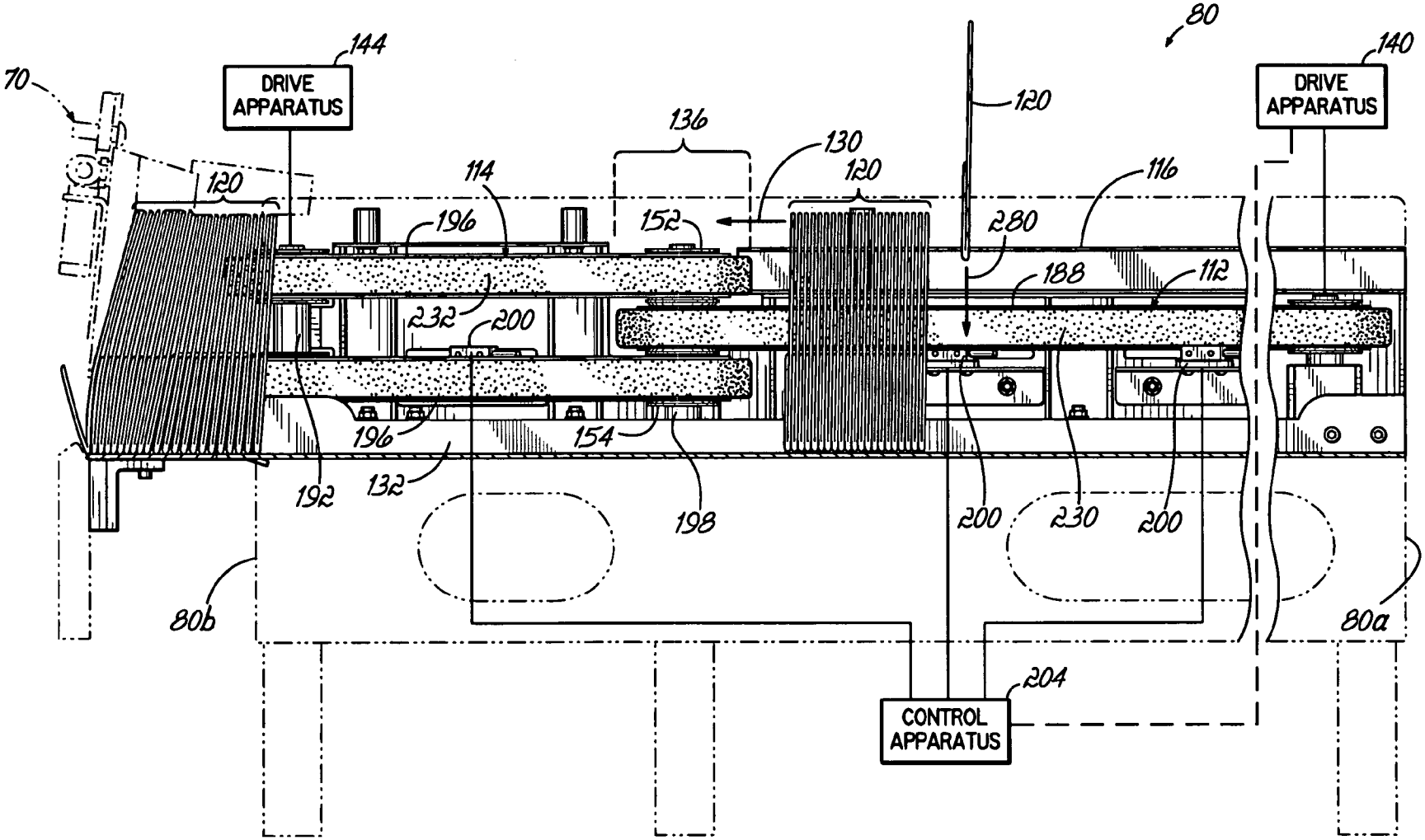
FIG. 2A is a view similar to FIG. 2, illustrating an alternative relative positioning of a conveying module.

With reference to FIGS. 2 and 2A, the second pair of conveyor assemblies 114 is positioned generally downstream, in the travel direction 130, of the first pair of conveyor assemblies 112. More specifically, the first pair of conveyor assemblies 112 extends generally from an upstream end 80*a* (FIG. 1) of module 80 to an interior portion of module 80, while the second pair of conveyor assemblies 114 extends generally from an opposite downstream end 80*b* to the interior portion of module 80. It is contemplated that one or both of the pairs of conveyor assemblies 112, 114 may alternatively extend into adjoining modules. For example, and without limitation, the second pair of conveyor assemblies 114 may extend into stuffing module 70 (as shown in the alternative embodiment of FIG. 2A). The extension of the first and second pairs of conveyor assemblies 112, 114 of this exemplary embodiment into the interior portion of module 80 is such that they define an overlap region 136 between them having a suitably chosen distance. Alternatively, it is contemplated that no overlap region may exist between the first and second pairs of conveyor assemblies 112, 114.

The overlap region 136 between the first and second pairs of conveyor assemblies 112, 114 is facilitated by the vertical arrangement if these two pairs of assemblies 112, 114. More particularly, in this embodiment, the first pair of conveyor assemblies 112 is disposed on a first horizontal plane that is lower relative to a second horizontal plane associated with the second pair of conveyor assemblies 114. As used herein, the terms "horizontal," "vertical," "up," "down," "top," "bottom," and derivatives thereof refer to the exemplary orientations of the figures and are therefore not intended to be limiting.

With continued reference to FIGS. 2 and 2A, and as discussed above, the first and second pairs of conveyor assemblies 112, 114 are driven by one or more drive apparatus 140, 144. In this regard, in this particular embodiment, the drive apparatus 140 is operatively coupled to a power shaft 186 (shown in phantom) disposed proximate the upstream end 80*a* of module 80 and which drives a belt 188 of one of the first pair of conveyor assemblies 112. Likewise, drive apparatus 144 is operatively coupled to a second power shaft 192 disposed proximate downstream end 80*b* and which drives a set of second belts 196, of one of the second pair of conveyor assemblies 114. Belts 188, 196 are supported in the interior portion of module 80, by a set of coaxial idler rollers 152, 154 coupled to frame 132 through a common shaft 198. Accordingly, the power shafts 186, 192 and the coaxial idler rollers 152, 154 define a generally closed-loop path of travel for each of the belts 188, 196.

As discussed above, drive apparatus 140, 144 permit controlling movement of the first and second pairs of conveyor assemblies 112, 114 independent from one another. To this end, the coaxial idler rollers 152, 154 are, though mounted on common shaft 198, rotatable independent from one another, for example, at different speeds. Accordingly, belts 188, 196 can travel in the travel direction 130 at speeds that are different from one another, thereby permitting envelopes 120 held by the first and second pairs of conveyor assemblies 112, 114 respectively at first and second speeds that are also different from or substantially equal to one another.

With continued reference to FIG. 2, a plurality of sensors 200 are positioned along the travel direction, for example, below each of the belts 188, 196 of the first and second pairs of conveyor assemblies 112, 114. The sensors 200 which may, for example be light-type sensors, are operatively coupled to a schematically depicted control apparatus 204 of module 80 to permit, as explained in further detail below, a steady stream of envelopes 120 to the stuffing module 70, regardless of gaps between the envelopes 120.

While the exemplary embodiment of the figures includes a pair of belts 196 defining the second pair of conveyor assemblies 112, it is contemplated that only on such belt 196 or belts in any other number may be present and still fall within the scope of the present disclosure.

Figure 3:
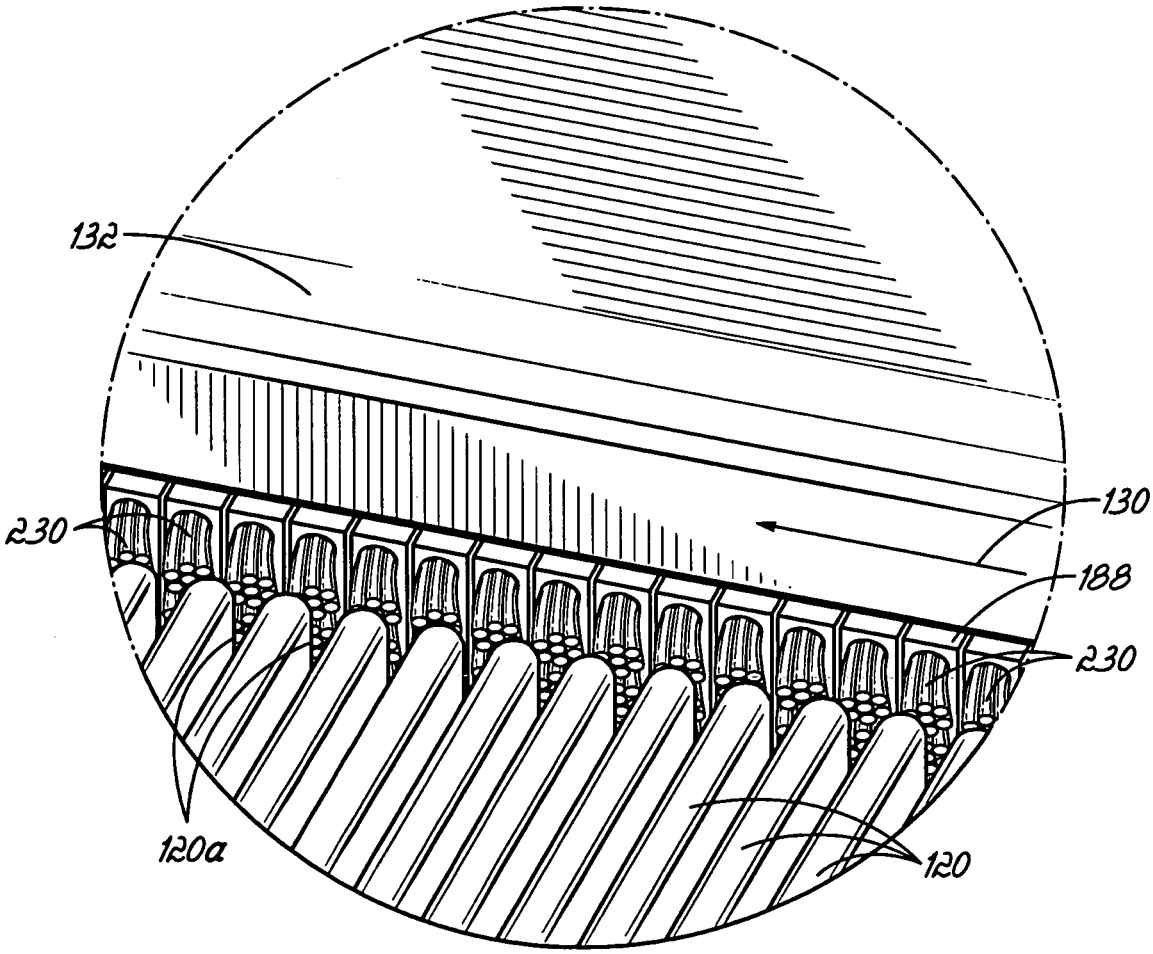
FIG. 3 is an enlarged view of the encircled area 3 of FIG. 4A.

With reference to FIG. 3, an enlarged view of an exemplary portion of a conveyor assembly of the first pair of conveyor assemblies 112 is illustrated. It is contemplated that the structure shown in FIG. 3 may additionally or alternatively apply to one or both of the conveyor assemblies of the second pair of conveyor assemblies 114. A plurality of deflectable elements in the form, in this embodiment, of bristles 230, extend from the surface of belt 188 toward the space provided for the envelopes 120. As used herein, the term "deflectable elements" and derivatives thereof refer to solid or solid structures that flex or bend upon the action of a force. Accordingly, while this embodiment depicts deflectable elements in the form of bristles, it is contemplated that they may alternatively take on other forms such as, without limitation, flexible straps.

Figure 4A:
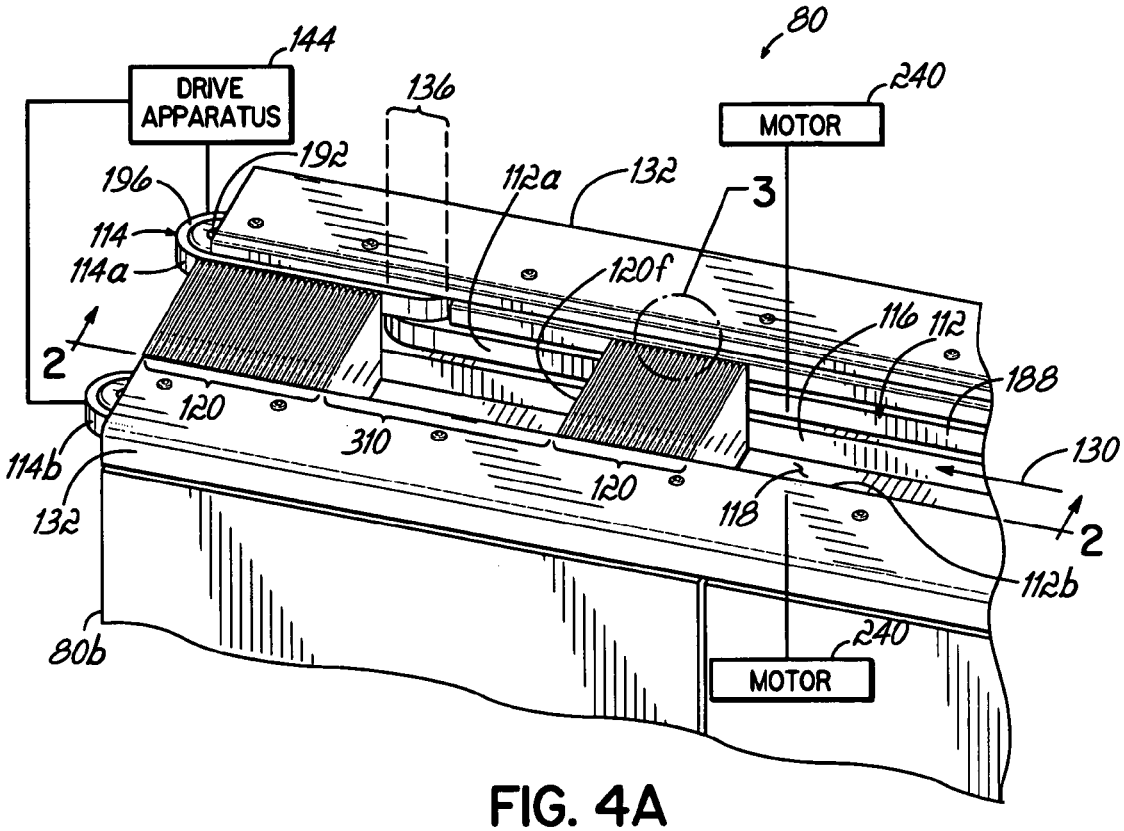
FIG. 4A is a perspective view of a portion of the conveying module of the converter of FIG. 1.
Figure 4B:
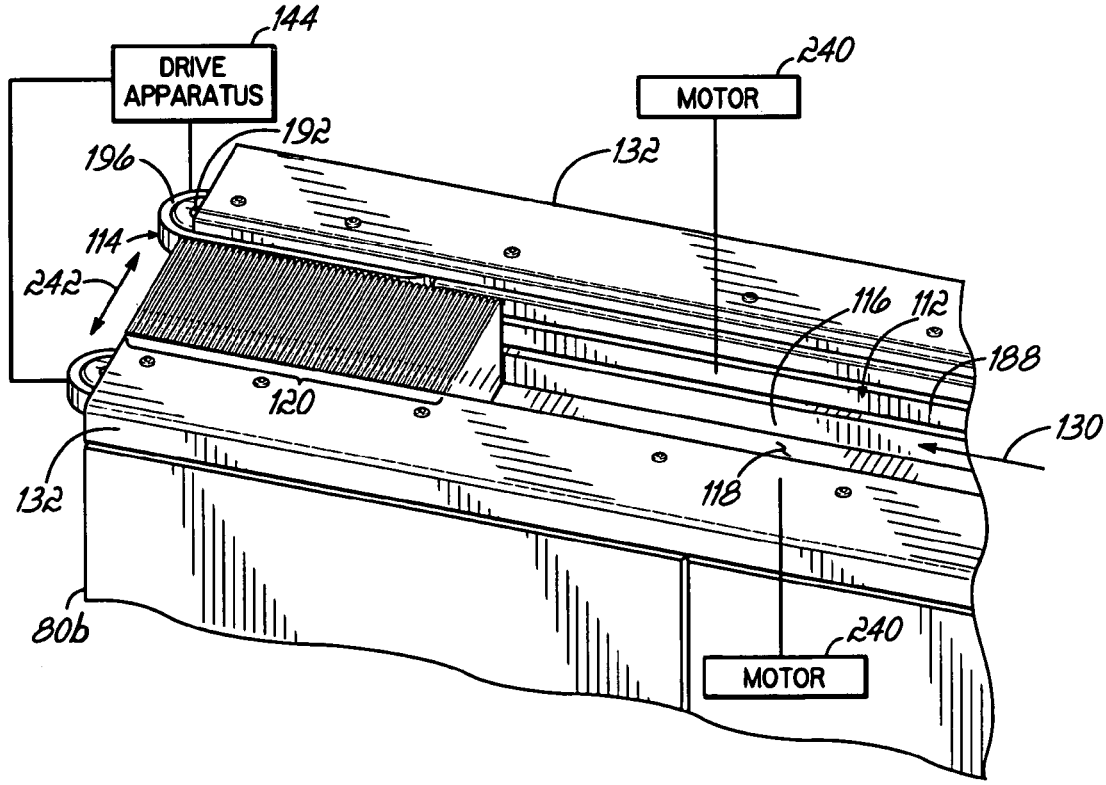
FIG. 4B is a perspective view similar to FIG. 4A showing an exemplary operation of the conveying module.

With reference to FIGS. 4A-4B, a pair of motors 240 (FIG. 4B) are operatively coupled to each of the conveyor assemblies 112*a*, 112*b* defining the first pair of conveyor assemblies 112 to permit accommodation of envelopes 120 having different widths. Motors 240 may, for example, be stepper motors such as model HRA08C available from Sick Stegmann GmbH, a member of the Sick AG Group of Waldkirch, Germany. Motors 240 cooperate with jack screws (not shown) to selectively move the conveyor assemblies 112*a*, 112*b* inwardly (i.e., toward one another) and outwardly (i.e., away from one another) along the direction of arrow 242 (FIG. 4B). In this regard, for example, both of the conveyor assemblies 112*a*, 112*b* may be selectively and/or automatically moved inwardly to accommodate an envelope 120 of relatively small width, thereby enabling engagement of the envelopes 120 by bristles 230. It is contemplated that, alternatively, only one of the conveyor assemblies 114*a*, 114*b* may be movable inwardly and outwardly relative to the other conveyor assembly. It is also contemplated that the conveyor assemblies 112*a*, 112*b* may instead have fixed positions relative to one another and therefore include other apparatus to facilitate engagement of envelopes 120 having different widths or include no such apparatus at all. As used herein, the term "width" in regard to envelopes 120 refers to the dimension of the envelopes 120 generally along the direction of arrow 242.

While the exemplary embodiment of the figures includes a pair of motors 240, each controlling movement of one of the conveyor assemblies 112*a*, 112*b*, it is contemplated that a single motor 240 or alternatively motors in any number may control one or both of the conveyor assemblies 112*a*, 112*b*. It is also contemplated that one or both of the conveyor assemblies 114*a*, 114*b* defining the second pair of conveyor assemblies 114 may be inwardly and outwardly movable to accommodate envelopes 120 of different widths.

Bristles 230 are made of a suitably flexible material such as, for example, nylon, such that they may flex and thereby accommodate envelopes 120 of different thicknesses inserted between the bristles 230. Moreover, the material making up bristles 230 is chosen to have some level of sturdiness, capable of closely pressing against the lateral edges 120*a* of the envelopes 120 and thereby maintain the envelopes 120 in a generally upright orientation. The flexible and sturdy characteristics of bristles 230 further permit driving of the envelopes 120 in the travel direction 130, as belt 188 moves in the same direction, while minimizing the likelihood of damaging the envelopes 120. Accordingly, bristles 230 move the envelopes 120 toward the second pair of conveyor assemblies 114 (FIG. 2).

Referring again to FIG. 2, the bristles 230, schematically represented in that figure by a dot pattern, permit insertion of envelopes 120 in a general vertical orientation, for example, by sliding the envelopes 120 between bristles 230 in the direction of arrow 280 (e.g., transverse to the travel direction 130). In this regard, therefore, the envelopes 120 may be inserted between bristles 230 of the first pair of conveyor assemblies 112 in a generally upright orientation. In operation, the envelopes 120 are carried by the first pair of conveyor assemblies 112 as they travel in the travel direction 130 and are subsequently transferred from the first pair of conveyor assemblies 112 to the second pair of conveyor assemblies 114 in the overlap region 136. To this end, in this exemplary embodiment, the belts 196 of the second pair of conveyor assemblies 114 are fitted with bristles 232 that may be of the same type and/or arrangement of bristles 230 of the first pair of conveyor assemblies 112 or of any other type and/or arrangement. In this embodiment, moreover, the belts 196 of the second pair of conveyor assemblies 114 are fitted with bristles 232 similar to the bristles 230 of the first pair of conveyor assemblies 112.

During transfer of the envelopes 120 from the first pair of conveyor assemblies 112 to the second pair of conveyor assemblies 114, the bristles 232 of the second pair of conveyor assemblies 114 flex in the travel direction (i.e., toward the downstream end 80*b* of module 80) to permit the envelopes 120 to be engaged between the plurality of bristles 232. Once engaged, the envelopes 120 are carried in the travel direction 130 by the bristles 232 toward the downstream end 80*b* and, in this particular embodiment, toward the stuffing module 70. During travel of the envelopes 120 through the overlap region 310, the envelopes 120 are carried simultaneously by bristles 230 and 232. The envelopes 120 are transferred to and carried by the second pair of conveyor assemblies 114 in a generally upright orientation.

Referring again to FIGS. 4A-4B, an exemplary operation of the envelope conveying module 80 is illustrated. FIG. 4A, in particular, depicts the presence of a gap 310 downstream of a leading envelope 120*f* of a stack of envelopes 120 carried by the first pair of conveyor assemblies 112. One or more of the sensors 200 (FIG. 2) detect the gap 310. For example, and without limitation, a sensor 200 may include a light-emitting component and a cooperating light-receiving component such that, only in the absence of an envelope or group of envelopes 120, light is received by the light-receiving component, thereby triggering a signal. In such instance, the signal may be sent to the control apparatus 204.

Control apparatus 204 is operatively coupled to drive apparatus 140 controlling movement of the first pair of conveyor assemblies 112. In this regard, when control apparatus 204 receives a signal associated with detection of the gap 310 by a sensor 200, control apparatus 204 accelerates movement of the belts 188 and bristles 230 of the first pair of conveyor assemblies 112. This acceleration results in the first pair of conveyor assemblies 112 moving in the travel direction 130 at a first speed that is greater relative to a second speed associated with the second pair of conveyor assemblies 114. This acceleration may close the gap 310 detected by the sensor(s) 200. Once the sensor(s) 200 no longer detect the gap 310, the control apparatus 204 may decelerate the first pair of conveyor assemblies 112 to thereby cause the first and second pairs of conveyor assemblies 112, 114 to travel at substantially equal speeds relative to one another. The ability of this exemplary embodiment to permit minimization or even closure of the gap 310 obviates the need by a user to continuously feed envelopes to the first pair of conveyor assemblies 112 without gaps or interruptions.

With continued reference to FIGS. 4A-4B and with further reference to FIG. 3, the flexibility of bristles 230 of the first pair of conveyor assemblies 112 permit the bristles 230 to flex in a direction opposite the travel direction 130. More specifically, movement of the first pair of conveyor assemblies 112 in the travel direction 130 may require contact between the bristles 230 with envelopes 120 held by the second pair of conveyor assemblies 114 in the overlap region 136. In this regard, the first pair of conveyor assemblies 112 travel relative to the envelopes 120 held by the second pair of conveyor assemblies, which is facilitated by flexing of the bristles 230 in the direction opposite the travel direction 130, in a clutching fashion.

Figure 5:
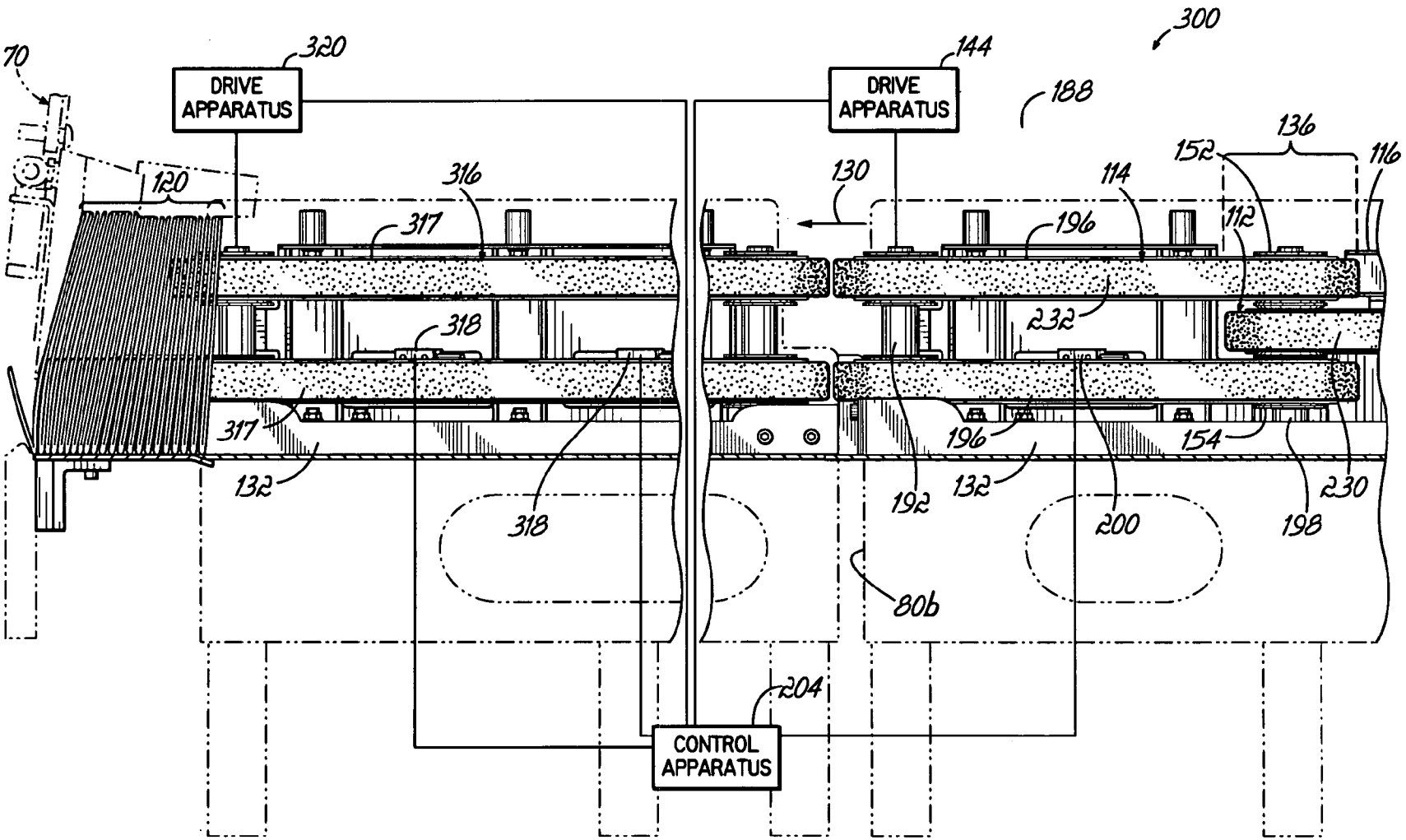
FIG. 5 is a view similar to FIG. 3, illustrating another embodiment of a conveying module.

With reference to FIG. 5, in which like reference numerals refer to like features of FIGS. 1-4B, another embodiment of an envelope-conveying apparatus 300 is illustrated. Conveying apparatus 300 includes, in addition to the first and second pairs of conveyor assemblies 112, 114, a third pair of conveyor assemblies 316 positioned downstream, in the travel direction (arrow 130), of the second pair of conveyor assemblies 114. In this particular embodiment, the third pair of conveyor assemblies 316 includes a pair of belts 317 generally parallel to and generally abutting the belts 196 of the second pair of conveyor assemblies 114. The belts 317 may be similar to belts 196 and therefore may include deflectable elements such as bristles. It is contemplated that the third pair of conveyor assemblies 316 may include a single belt or belts in any number other than the two depicted here. Transfer of envelopes 120 from the second pair 114 to the third pair of conveyor assemblies 316 maintains the envelopes in a generally upright orientation. Moreover, the third pair of conveyor assemblies 316 in this exemplary embodiment extends into the inserting or stuffing module 70 (shown in phantom).

The third pair of conveyor assemblies 316 is driven by a drive apparatus 320 operatively coupled to control apparatus 204, although it is contemplated that the third pair of conveyor assemblies 316 may instead be driven by one of the drive apparatus 140, 144 associated with the first and second pairs of conveyor assemblies 112, 114. Drive apparatus 320 permits controlling movement of the third pair of conveyor assemblies 316 independently from the first and second pairs of conveyor assemblies 112, 114. In this regard, for example, the third pair of conveyor assemblies 316 may be selectively driven at speeds that are different from those associated with the first and/or second pairs of conveyor assemblies 112, 114.

A plurality of sensors 318 are associated with the third pair of conveyor assemblies 316 and are similar in relative location, type, structure, and/or function to the sensors 200 associated with the first and second pairs of conveyor assemblies 112, 114, the description of which may be referred to for an understanding of sensor(s) 318 as well. Sensors 318 are configured to detect any gaps upstream of a group of envelopes 120 carried by the third pair of conveyor assemblies 316. When control apparatus 204 receives a signal associated with detection of such gap by a sensor 318, control apparatus 204 accelerates movement of the belts 196 of the second pair of conveyor assemblies 114. This acceleration results in the second pair of conveyor assemblies 114 moving in the travel direction 130 at a second speed that is greater relative to a third speed associated with the third pair of conveyor assemblies 316. This acceleration may close the gap detected by the sensor(s) 318.

Once the sensor(s) 318 no longer detect the gap, the control apparatus 204 may decelerate the second pair of conveyor assemblies 114 to thereby cause the second and third pairs of conveyor assemblies 114, 316 to travel at substantially equal speeds relative to one another. The ability of this exemplary embodiment to permit minimization or even closure of the gap upstream of envelopes 120 carried by the third pair of conveyor assemblies 316 obviates the need for the second pair of conveyor assemblies 114 to have a continuous flow of envelopes 120 i.e., a flow without gaps or interruptions.

Figure 6:
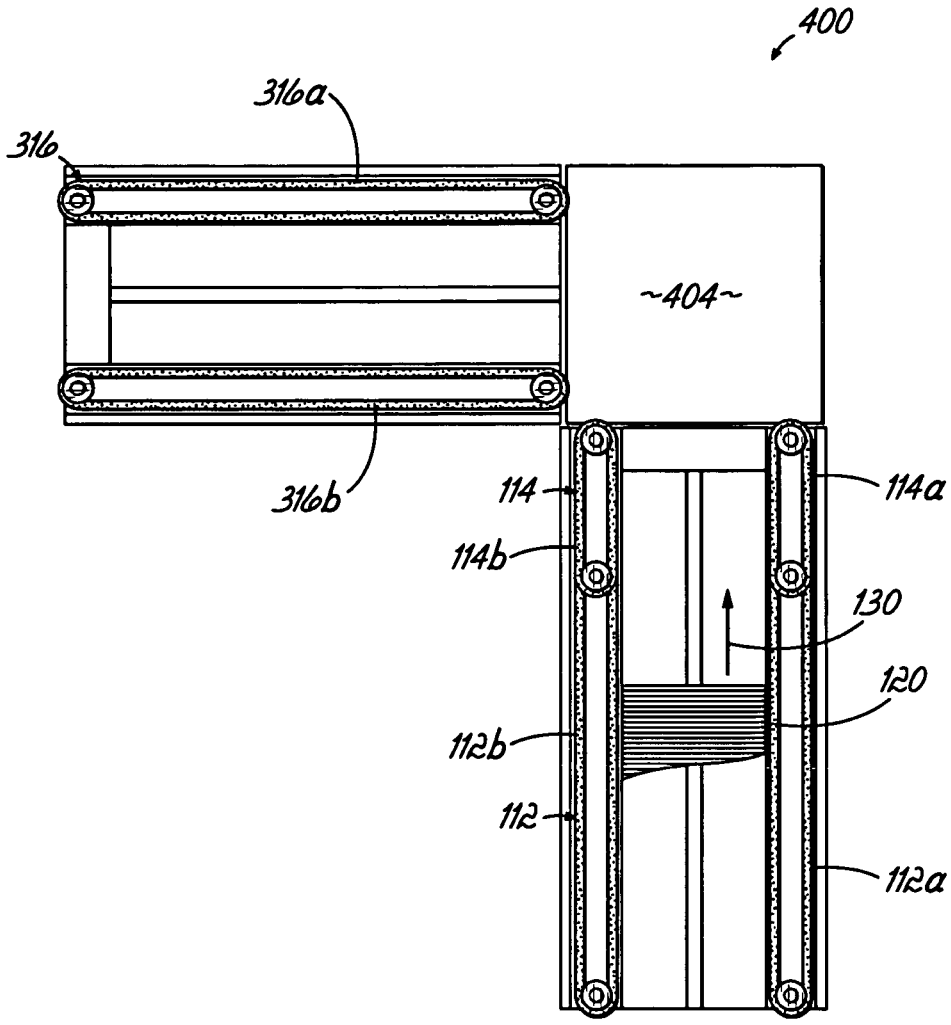
FIG. 6 is a top schematic view of another embodiment of a conveying module.

With reference to FIG. 6, in which like reference numerals refer to like features of FIGS. 1-5, another embodiment of an envelope-conveying apparatus 400 is illustrated. Envelope-conveying apparatus 400 is similar to envelope-conveying apparatus 300 of FIG. 5, the description of which may be referred to for an understanding of envelope-conveying apparatus 300 as well. Envelope-conveying apparatus 400 includes a second pair of conveyor assemblies 114 oriented at an angle transverse to the third pair of conveyor assemblies 316 and therefore transverse to the travel direction (arrow 130) associated with the third pair of conveyor assemblies 316. In this particular embodiment, the second and third pairs of conveyor assemblies 114, 316 are oriented generally orthogonal to one another although this is merely illustrative of the transverse orientation discussed above, and therefore is not intended to be limiting. A schematically-depicted transition section 404 is operatively coupled to the second and third pairs of conveyor assemblies 114, 316 and is configured to retrieve envelopes 120 from the second pair 114, re-orient them, and transfer them onto the third pair of conveyor assemblies 316. Accordingly, transition section 404 transfers envelopes 120 from the second pair of conveyor assemblies 114 to the third pair of conveyor assemblies 316.

While the present invention has been illustrated by a description of various embodiments and while these embodiments have been described in considerable detail, it is not intended to restrict or in any way limit the scope of the appended claims to such detail. For example, and without limitation, other alternatives structures may replace bristles 230, 232, so long as they provide the ability to engage envelopes and carry them in a generally upright orientation. For example, and also without limitation, such structures may be in the form of flexible flaps. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of the general inventive concept.

What is claimed is:

1. An apparatus for conveying envelopes traveling in a travel direction in a generally upright orientation, comprising:

a first pair of conveyor assemblies disposed opposite one another and configured to engage lateral edges of the envelopes, said first pair of conveyor assemblies configured to move the envelopes in the travel direction; and a second pair of conveyor assemblies disposed opposite one another and positioned downstream of said first pair of conveyor assemblies in the travel direction, said second pair of conveyor assemblies configured to move the envelopes in the travel direction independently of said first pair of conveyor assemblies, wherein at least one of said first or second pairs of conveyor assemblies includes at least one conveyor belt and a plurality of flexible and deflectable elements extending from said belt for engaging the lateral edges of the envelopes, said flexible deflectable elements being bendable with respect to said belt by action of the engagement of the lateral edges of the envelopes therewith so as to position each of the lateral edges between displaced flexible and deflectable elements; and wherein at least a portion of said first pair of conveyor assemblies overlaps said second pair of conveyor assemblies in the travel direction.

2. The apparatus of claim 1, wherein said flexible and deflectable elements flex in response to a thickness of the envelopes.

3. The apparatus of claim 1, wherein said first and second pairs of conveyor assemblies include flexible and deflectable elements for engaging the lateral edges of the envelopes; and said flexible and deflectable elements of said first pair of conveyor assemblies are flexible in a direction opposite the travel direction of said first pair of conveyor assemblies and said flexible and deflectable elements thereof are moveable relative to envelopes held by said second pair of conveyor assemblies and also engaged by flexible and deflectable elements of said first pair of conveyor assemblies.

4. Apparatus as in claim 3, wherein said flexible and deflectable elements of said second pair of conveyor assemblies are flexible in said travel direction when engaging envelopes also engaged by said flexible and deflectable elements of said first pair of said conveyor assemblies.

5. The apparatus of claim 1, wherein said flexible and deflectable elements each include a plurality of bristles.

6. The apparatus of claim 1, wherein said first and second pairs of conveyor assemblies are configured to respectively hold first and second envelopes in generally upright orientations, said first and second pairs of conveyor assemblies being configured to move the first and second envelopes at respective first and second speeds that are substantially equal to one another.

7. The apparatus of claim 1, further comprising:

a drive apparatus for driving said first pair of conveyor assemblies; and at least one sensor operatively coupled to said drive apparatus and configured to detect a gap in front of a first envelope carried by said first pair of conveyor assemblies in the travel direction and send a corresponding signal to said drive apparatus;

wherein said drive apparatus is responsive to said signal to advance said first pair of conveyor assemblies and move the first envelope at a first speed greater than a second speed associated with the second pair of conveyor assemblies.

8. The apparatus of claim 7, wherein said drive apparatus is configured, in response to said signal, to accelerate said first pair of conveyor assemblies to thereby close the gap detected by said at least one sensor.

9. The apparatus of claim 1, further comprising:

a motor operatively coupled to at least one of said first or second pairs of conveyor assemblies for moving at least a portion thereof in response to a width of the envelopes.

10. The apparatus of claim 1, further comprising:

a third pair of conveyor assemblies disposed opposite one another and positioned downstream of said second pair of conveyor assemblies in the travel direction, said third pair of conveyor assemblies operable to move the envelopes independently of said second pair of conveyor assemblies.

11. The apparatus of claim 10, wherein said first, second, and third pairs of conveyor assemblies are oriented generally parallel to one another.

12. The apparatus of claim 10, wherein said third pair of conveyor assemblies is oriented transversely to said second pair of conveyor assemblies.

13. An apparatus for conveying envelopes traveling in a travel direction in a generally upright orientation, comprising:

a first pair of conveyor assemblies disposed opposite one another and each including a belt and a plurality of flexible and deflectable elements extending from said belts for engaging lateral edges of the envelopes, said first pair of conveyor assemblies configured to move the envelopes in the travel direction;

a second pair of conveyor assemblies disposed opposite one another, each including a belt and a plurality of flexible and deflectable elements extending from the belts of the second pair of conveyor assemblies for engaging lateral edges of the envelopes, and positioned downstream of said first pair of conveyor assemblies, said second pair of conveyor assemblies configured to move the envelopes in the travel direction independently of said first pair of conveyor assemblies, said flexible and deflectable elements configured to bend by action of the engagement of the lateral edges of the envelopes therewith;

said first and second pairs of conveyor assemblies having respective overlapping portions; and wherein flexible and deflectable elements of said first pair of conveyor assemblies are oriented to engage envelopes engaged by said second pair of conveyor assemblies and to deflect upon such engagement with said envelopes.

14. Apparatus as in claim 13 further including a drive apparatus for driving said first pair of conveyor assemblies; and at least one sensor operatively coupled to said drive apparatus and configured to detect a gap in front of a first envelope carried by said first pair of conveyor assemblies in the travel direction, said drive apparatus being responsive to a signal received from said at least one sensor to accelerate the first envelope and thereby close the gap detected by said at least one sensor.

15. An automatic envelope stuffing apparatus having a first end associated with feeding of a roll of paper, and a processing apparatus for converting the roll of paper into discrete sheets for feeding the discrete sheets into envelopes, further comprising:

a conveying apparatus for conveying the envelopes toward the stuffing apparatus in a travel direction, said conveying apparatus including:

(a) a first pair of conveyor assemblies disposed opposite one another and configured for engaging lateral edges of the envelopes, said first pair of conveyor assemblies configured to move the envelopes in the travel direction; and (b) a second pair of conveyor assemblies disposed opposite one another and positioned downstream of said first pair of conveyor assemblies in the travel direction, said second pair of conveyor assemblies configured to move the envelopes in the travel direction independently of said first pair of conveyor assemblies, wherein at least one of said first or second pairs of conveyor assemblies each includes flexible and deflectable elements for engaging the lateral edges of the envelopes, said flexible and deflectable elements being mounted on respective belts of said assemblies, said flexible and deflectable elements being bendable with respect to said belts by action of the engagement of the lateral edges of the envelopes therewith so as to position each of the lateral edges between displaced flexible and deflectable elements, said first and second pairs of conveyor assemblies overlapping one another at respective ends thereof; and said first and second pairs of conveyor assemblies at said ends each engaging at least a same envelope simultaneously.

16. The apparatus of claim 15, further comprising:

a motor operatively coupled to at least one of said first or second pairs of conveyor assemblies for moving at least a portion thereof in response to a width of the envelopes.

17. A method of conveying envelopes traveling in a travel direction, comprising:

sliding an envelope in a generally upright orientation between a first set of flexible and deflectable elements engaging opposite lateral edges of the envelope;

bending and displacing the flexible and deflectable elements by action of the engagement of the lateral edges of the envelope therewith so as to position each of the lateral edges between displaced flexible and deflectable elements;

moving the flexible and deflectable elements to thereby move the envelope in the travel direction;

transferring the envelope in the generally upright orientation to a second set of flexible and deflectable elements while still engaged by said first set of flexible and deflectable elements; and moving the second set of flexible and deflectable elements independently of the first set of flexible and deflectable elements to thereby move the envelope in the travel direction, away from said first set of flexible and deflectable elements.

18. The method of claim 17, further comprising:

flexing the deflectable elements of the first set in response to a thickness of the envelope.

19. The method of claim 17, further comprising:

detecting a gap in front of the envelope in the travel direction; and accelerating movement of the first set of deflectable elements in the travel direction in response to detection of the gap.

20. The method of claim 19, wherein accelerating movement of the first set of deflectable elements closes the gap.

21. The method of claim 17, wherein sliding the envelope in the generally upright orientation includes moving the envelope in a direction transverse to the travel direction.

22. The method of claim 17, wherein transferring the envelope in the generally upright orientation to the second set of flexible and deflectable elements includes moving the envelope in the travel direction.

23. The method of claim 17, wherein transferring the envelope in the generally upright orientation to the second set of flexible and deflectable elements includes moving the envelope in a direction transverse to the travel direction.

24. The method of claim 18, further comprising:

simultaneously engaging the envelope with the first and second sets of flexible and deflectable elements.

25. The method of claim 18, further comprising:

moving the first set of flexible and deflectable elements relative to an envelope held by the second set of flexible and deflectable elements.

26. The method of claim 18, further comprising:

moving the flexible and deflectable elements toward the envelope in response to a width of the envelope.

27. The method of claim 17 wherein said moving comprises a clutching action between said elements and said envelopes.

28. A method of conveying envelopes traveling in a travel direction, comprising:

sliding an envelope in a generally upright orientation between a first set of deflectable elements engaging opposite lateral edges of the envelope;

moving the deflectable elements to thereby move the envelope in the travel direction;

transferring the envelope in the generally upright orientation to a second set of deflectable elements;

moving the second set of deflectable elements independently of the first set of deflectable elements to thereby move the envelope in the travel direction;

wherein sliding of the envelope in a generally upright orientation includes downward movement of the envelope in the upright orientation thereof.

* * * * *